US009981797B2

(12) United States Patent
Aksan et al.

(10) Patent No.: US 9,981,797 B2
(45) Date of Patent: May 29, 2018

(54) NESTED INSULATED PACKAGING

(71) Applicant: Pratt Corrugated Holdings, Inc., Conyers, GA (US)

(72) Inventors: Yavuz Aksan, Suwanee, GA (US); Joshua David Kayne, Peachtree City, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 53 days.

(21) Appl. No.: 14/690,501

(22) Filed: Apr. 20, 2015

(65) Prior Publication Data

US 2016/0304267 A1 Oct. 20, 2016

(51) Int. Cl.

| | |
|---|---|
| ***A47J 39/00*** | (2006.01) |
| ***A47J 41/00*** | (2006.01) |
| ***B65D 81/38*** | (2006.01) |
| ***B65D 83/72*** | (2006.01) |
| ***B65D 5/50*** | (2006.01) |
| ***B65D 5/468*** | (2006.01) |
| ***B65D 5/02*** | (2006.01) |
| ***B65B 7/20*** | (2006.01) |
| ***B65D 77/04*** | (2006.01) |
| ***B65D 5/46*** | (2006.01) |
| ***B65D 5/49*** | (2006.01) |

(52) U.S. Cl.

CPC ..... *B65D 81/3862* (2013.01); *B65B 7/20* (2013.01); *B65D 5/46096* (2013.01); *B65D 5/48046* (2013.01); *B65D 77/042* (2013.01); *B65D 81/3816* (2013.01); *B65D 81/3858* (2013.01)

(58) Field of Classification Search

CPC .. B65D 81/3816; B65D 5/508; B65D 5/5083; B65D 5/0254; B65D 5/4608; B65D 81/3834

See application file for complete search history.

(56) References Cited

U.S. PATENT DOCUMENTS

| | | | |
|---|---|---|---|
| 1,868,996 | A | 7/1932 | Sharp |
| 2,554,004 | A | 5/1951 | Bergstein |
| 2,927,720 | A | 3/1960 | Adams |
| 2,934,251 | A | 4/1960 | Kramer |

(Continued)

FOREIGN PATENT DOCUMENTS

| | | |
|---|---|---|
| EP | 2990196 | 3/2016 |
| FR | 3008685 | 7/2013 |
| GB | 1272730 | 5/1972 |

OTHER PUBLICATIONS

US 8,845,046, 09/2014, Nomura et al. (withdrawn)

(Continued)

*Primary Examiner* — Andrew T Kirsch

(74) *Attorney, Agent, or Firm* — Taylor English Duma LLP

(57) ABSTRACT

A nested insulated packaging assembly includes: an outer box including an outer top side wall, an outer bottom side wall, and a plurality of outer lateral side walls; an inner box received in the outer box, the inner box including an inner top side wall, an inner bottom side wall, and a plurality of inner lateral side walls; a first thermal liner contacting a one of the outer lateral side walls of the outer box and a one of the inner lateral side walls of the inner box; and a second thermal liner contacting a second of the outer lateral side walls of the outer box and a second of the inner lateral side walls of the inner box.

24 Claims, 8 Drawing Sheets

(56) References Cited

U.S. PATENT DOCUMENTS

| | | | | |
|---|---|---|---|---|
| 3,222,843 | A | 12/1965 | Schneider | |
| 4,049,188 | A | 9/1977 | Persson | |
| 4,418,864 | A | 12/1983 | Neilsen | |
| 5,418,031 | A | 5/1995 | English | |
| 5,441,170 | A | 8/1995 | Bane, III | |
| 6,325,281 | B1 | 12/2001 | Grogan | |
| 6,343,696 | B1 | 2/2002 | McCormick et al. | |
| 6,378,733 | B1 * | 4/2002 | Boonzaier | B65D 5/103 220/630 |
| 6,736,309 | B1 | 5/2004 | Westerman et al. | |
| 6,837,420 | B2 | 1/2005 | Westerman et al. | |
| 6,868,982 | B2 | 3/2005 | Gordon | |
| 6,875,486 | B2 | 4/2005 | Miller | |
| 6,910,582 | B2 | 6/2005 | Lantz | |
| 7,083,147 | B2 | 8/2006 | Movsesian et al. | |
| 7,094,192 | B2 | 8/2006 | Schoenberger et al. | |
| 7,229,677 | B2 | 6/2007 | Miller | |
| 7,422,143 | B2 | 9/2008 | Mayer | |
| 7,452,316 | B2 | 11/2008 | Cals et al. | |
| 7,500,593 | B2 | 3/2009 | Mayer | |
| 7,624,911 | B2 | 12/2009 | Spurrell et al. | |
| 7,681,405 | B2 | 3/2010 | Williams | |
| 7,841,512 | B2 | 11/2010 | Westerman et al. | |
| 7,870,992 | B2 | 1/2011 | Schille et al. | |
| 8,101,259 | B2 | 1/2012 | Kuboniwa | |
| 8,250,882 | B2 | 8/2012 | Mustafa et al. | |
| 8,365,943 | B2 | 2/2013 | Bentley | |
| 8,424,335 | B2 | 4/2013 | Corder et al. | |
| 8,453,477 | B2 | 6/2013 | Crespo et al. | |
| 8,613,202 | B2 | 12/2013 | Williams | |
| 8,728,605 | B2 | 5/2014 | Payne et al. | |
| 8,763,423 | B2 | 7/2014 | Tattam | |
| 8,763,811 | B2 | 7/2014 | Lantz | |
| 8,763,886 | B2 | 7/2014 | Hall | |
| 8,887,515 | B2 | 11/2014 | Patstone | |
| 8,938,986 | B2 | 1/2015 | Matta et al. | |
| 9,550,618 | B1 | 1/2017 | Jobe | |
| 9,605,382 | B2 | 3/2017 | Virtanen | |
| 9,751,683 | B1 | 9/2017 | Jobe | |
| 2002/0050147 | A1 | 5/2002 | Mai et al. | |
| 2004/0016212 | A1 | 1/2004 | Miller | |
| 2004/0081727 | A1 | 4/2004 | Kelly et al. | |
| 2004/0151851 | A1 | 8/2004 | Miller | |
| 2005/0159282 | A1 | 7/2005 | Schoenberger et al. | |
| 2005/0163947 | A1 | 7/2005 | Miller | |
| 2005/0178142 | A1 | 8/2005 | Perry et al. | |
| 2005/0224501 | A1 | 10/2005 | Folkert et al. | |
| 2005/0241978 | A1 | 11/2005 | Plue et al. | |
| 2006/0003057 | A1 | 1/2006 | Kelly et al. | |
| 2006/0174648 | A1 | 8/2006 | Lantz | |
| 2007/0051782 | A1 | 3/2007 | Lantz | |
| 2008/0095959 | A1 | 4/2008 | Warner et al. | |
| 2008/0099492 | A1 | 5/2008 | Mayer | |
| 2008/0289302 | A1 | 11/2008 | Vulpitta | |
| 2008/0296356 | A1 | 12/2008 | Hatcher et al. | |
| 2009/0078708 | A1 | 3/2009 | Williams | |
| 2009/0193765 | A1 | 8/2009 | Lantz | |
| 2009/0283578 | A1 | 11/2009 | Miller | |
| 2010/0072105 | A1 | 3/2010 | Glaser et al. | |
| 2010/0139878 | A1 | 6/2010 | Nicolucci | |
| 2010/0314397 | A1 | 12/2010 | Williams et al. | |
| 2011/0042449 | A1 | 2/2011 | Copenhaver et al. | |
| 2011/0100868 | A1 | 5/2011 | Lantz | |
| 2011/0114513 | A1 | 5/2011 | Miller | |
| 2011/0127272 | A1 | 6/2011 | Crespo et al. | |
| 2011/0241514 | A1 | 10/2011 | Nomura et al. | |
| 2011/0284556 | A1 | 11/2011 | Palmer et al. | |
| 2011/0311758 | A1 | 12/2011 | Burns et al. | |
| 2012/0145568 | A1 | 6/2012 | Collison et al. | |
| 2012/0248101 | A1 | 10/2012 | Tumber et al. | |
| 2012/0251818 | A1 | 10/2012 | Axrup et al. | |
| 2013/0094791 | A1 | 4/2013 | Aspenson et al. | |
| 2013/0055750 | A1 | 5/2013 | Mustafa et al. | |
| 2013/0112694 | A1 | 5/2013 | Bentley | |
| 2013/0140317 | A1 | 6/2013 | Roskoss | |
| 2013/0291584 | A1 | 11/2013 | Chapman, Jr. | |
| 2014/0000306 | A1 | 1/2014 | Chapman, Jr. | |
| 2014/0021208 | A1 | 1/2014 | Anti et al. | |
| 2014/0144161 | A1 | 5/2014 | Pointer et al. | |
| 2014/0151382 | A1 | 6/2014 | White et al. | |
| 2014/0319018 | A1 | 10/2014 | Collison | |
| 2014/0353317 | A1 | 12/2014 | Ranade et al. | |
| 2014/0367393 | A1 | 12/2014 | Ranade | |
| 2015/0068242 | A1 | 3/2015 | Patstone | |
| 2017/0225870 | A1 | 8/2017 | Collison | |
| 2018/0086539 | A1 | 3/2018 | Aksan et al. | |

OTHER PUBLICATIONS

Aksan, Yavuz; U.S. Patent Application entitled: Adjustable Insulation Packaging having U.S. Appl. No. 14/703,094, filed 5/4/20145, 30 pgs.

Grano, Ernesto; Restriction Requirement for U.S. Appl. No. 14/703,904, filed May 4, 2015, dated Sep. 15, 2017, 7 pgs.

Greenblue; "Environmental Technical Briefs of Common Packaging Materials—Fiber-Based Materials", Sustainable Packaging Solution, 2009, 19 pgs.

MP Global Products; Article entitled: "Thermopod mailer envelopes and Thermokeeper insulated box liners", located at <http://www.mhpn.com/product/thermopod_mailer_envelopes_and_thermokeeper_insulated_box_liners/packaging, accessed on Aug. 30, 2017, 2 pgs.

UN Packaging; Article entitled: "CooLiner® Insulated Shipping Bags", available at <http://www.chem-tran.com/packaging/supplies/cooliner-insulated-shipping-bags.php>, accessed on Aug. 30, 2017, 2 pgs.

Aksan, Yavuz; Non-Final Office Action for U.S. Appl. No. 14/703,904, filed May 4, 2015, dated Dec. 29, 2017, 39 pgs.

* cited by examiner

NESTED INSULATED PACKAGING

TECHNICAL FIELD

This disclosure relates to packaging. More specifically, this disclosure relates to nested insulated packaging.

BACKGROUND

Packaging perishable items, pharmaceuticals, and other temperature sensitive items poses a challenge to suppliers and consumers alike. For example, suppliers are faced with the challenge of shipping perishable items, pharmaceuticals, and other temperature sensitive items economically while minimizing spoilage, browning, bruising, over-ripening, and other forms of transit breakage. Similar challenges exist for individual consumers shipping perishable items, pharmaceuticals, and other temperature sensitive items.

SUMMARY

Disclosed is a nested insulated packaging assembly comprising: an outer box including an outer top side wall, an outer bottom side wall, and a plurality of outer lateral side walls; an inner box received in the outer box, the inner box including an inner top side wall, an inner bottom side wall, and a plurality of inner lateral side walls; a first thermal liner contacting a one of the outer lateral side walls of the outer box and a one of the inner lateral side walls of the inner box; and a second thermal liner contacting a second of the outer lateral side walls of the outer box and a second of the inner lateral side walls of the inner box.

Also disclosed a method of assembling a nested insulated packaging comprising: positioning a first thermal liner in an outer box, the outer box including an outer top side wall, an outer bottom side wall, and a plurality of outer lateral side walls, the first thermal liner contacting a one of the outer lateral side walls of the outer box; positioning a second thermal liner in the outer box, the second thermal liner contacting a second of the outer lateral side walls of the outer box; positioning an inner box in the outer box, the inner box including an inner top side wall, an inner bottom side wall, and at least one inner lateral side wall, the first thermal liner contacting a one of the inner lateral side walls of the inner box and the second thermal liner contacting a second of the inner lateral side walls of the inner box.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Disclosed is nested insulated packaging and associated methods, systems, devices, and various apparatus. The nested insulated packaging includes an outer box, an inner box, and a thermal liner. It would be understood by one of skill in the art that the disclosed nested insulated packaging is described in but a few exemplary embodiments among many. No particular terminology or description should be considered limiting on the disclosure or the scope of any claims issuing therefrom. Directional references such as "up," "down," "top," "left," "right," "front," "back," and "corners," among others are intended to refer to the orientation as shown and described in the figure (or figures) to which the components and directions are referencing.

Figure 1:
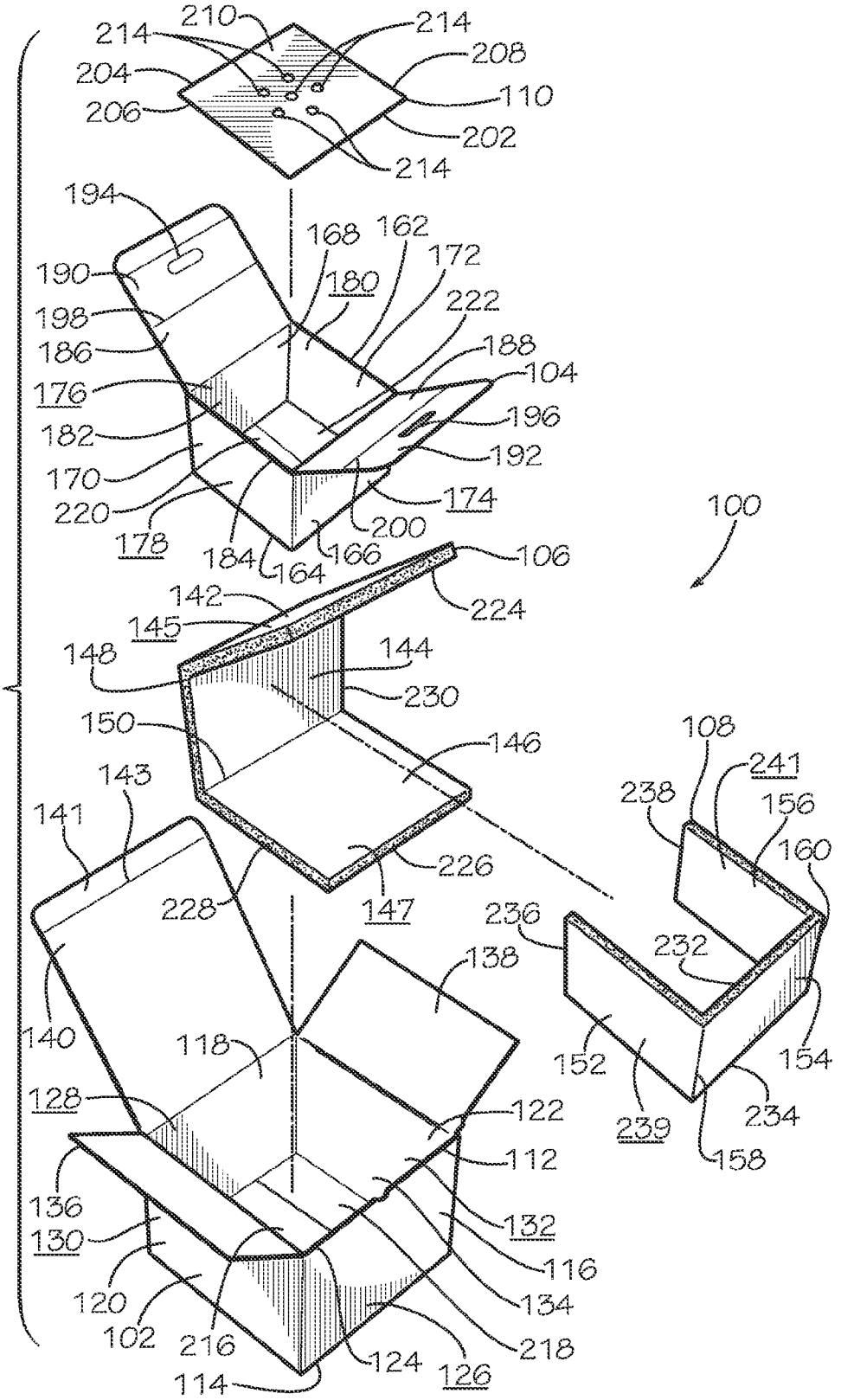
FIG. 1 is an exploded view of nested insulated packaging in accordance with one embodiment of the present disclosure including an outer box, an inner box, a first thermal liner, a second thermal liner, and a pad.

One embodiment of nested insulated packaging assembly 100 is disclosed and described in FIG. 1. The nested insulated packaging assembly 100 includes an outer box 102, an inner box 104, a first thermal liner 106, a second thermal liner 108, and a divider 110.

The outer box 102 includes a top end 112, a bottom end 114, a front lateral side wall 116, a back lateral side wall 118, a left lateral side wall 120, and a right lateral side wall 122. The front lateral side wall 116 includes an inner surface (not shown) and an outer surface 126. The back lateral side wall 118 includes an inner surface 128 and an outer surface (not shown). The left lateral side wall 120 defines an inner surface (not shown) and an outer surface 130. The right lateral side wall 122 defines an inner surface 132 and an outer surface (not shown). The inner surfaces of the lateral side walls 116,118,120,122 define an outer storage cavity 134. The lateral side walls 116,118,120,122 define a top opening 124 at the top end 112 of the outer box 102. A distance from the top end 112 to the bottom end 114 defines an outer box height.

As shown in FIG. 1, in the present embodiment, the outer box 102 includes a top left flap 136 connected to the left lateral side wall 120 and a top right flap 138 connected to the right lateral side wall 122 at the top end 112. The outer box 102 also includes a back flap 140 connected to the back lateral side wall 118 at the top end 112. When closed, the top left flap 136, top right flap 138, and back flap 140 define a top side wall of the outer box 102. In various embodiments, the back flap 140 includes a locking panel 141 connected to the back flap 140 through a bend line 143. The flaps 136,138,140 may be used to close the top opening 124. In various embodiments, the outer box 102 includes a bottom left flap 216 connected to the left lateral side wall 120 at the bottom end 114 and a bottom right flap 218 connected to the right lateral side wall 122 at the bottom end 114. When closed, the bottom flaps 216,218 define a bottom side wall of the outer box 102. The number of flaps on the outer box 102 should not be considered limiting on the current disclosure. In addition, the location, number, and shape of the flaps should not be considered limiting. For example, in various other embodiments, each lateral side wall 116,118, 120,122 includes a flap at the top end 112 of the outer box 102.

In various embodiments, the outer box 102 also includes bottom flaps at each lateral side wall 116,118,120,122 at the bottom end 114. In various embodiments, any of the flaps on the outer box 102 may be integral with the outer box 102 or connected to the outer box 102. In various embodiments, any of the flaps on the outer box 102 may include connecting mechanisms such as slats, snaps, adhesive, hooks and loops, and any other connecting mechanisms for selectively holding the flaps in place when the top opening 124 is closed. In addition, the number of side walls outer box 102 should not be considered limiting on the current disclosure. In various embodiments, the outer box 102 includes the top side wall, the bottom side wall, and at least one lateral side wall. For example, in various embodiments, the outer box 102 may be a cylindrically shaped box with a plurality of side walls curved into a cylindrical shape, where each side wall is a portion of the curved cylindrical perimeter of the box, such as where each side wall is a quarter portion of the perimeter, a half portion of the perimeter, or a third portion of the perimeter, or where one side wall is a third portion of the perimeter and one side wall is a two-thirds portion of the perimeter.

The nested insulated packaging assembly 100 also includes the first thermal liner 106 in various embodiments. In various embodiments, the first thermal liner 106 includes a top end 224, a bottom end 226, a left side end 228, and a right side end 230. As shown in FIG. 1, the first thermal liner defines an outer surface 145 and an inner surface 147 between the ends 224,226,228,230. In various embodiments, the first thermal liner 106 includes a top fold 142 defined between the top end 224 and a first bend line 148, a back fold 144 defined between the first bend line 148 and a second bend line 150, and a bottom fold 146 defined between the bend line 150 and the bottom end 226. In various embodiments, the top fold 142 is foldable relative to the back fold 144 at the first bend line 148 and the bottom fold 146 is foldable relative to the back fold 144 at the second bend line 150.

The first thermal liner 106 is used to wrap the contents of the outer box 102 vertically and line the bottom flaps 216,218 at the bottom end 114 forming the bottom side of the outer box 102, the back lateral side wall 118, and the flaps 136,138,140 at the top end 112 forming the top side of the outer box 102. In various embodiments, when the first thermal liner 106 is positioned in the outer box 102, the inner surface 147 faces the contents of the outer box 102 in the outer storage cavity 134 and the outer surface 145 faces the bottom flaps 216,218 at the bottom end 114, the back lateral side wall 118, and the flaps 136,138,140 at the top end 112 of the outer box 102. In various other embodiments, the outer surface 145 may face any of the lateral side walls 116,118,120,122 as desired. A distance from the first bend line 148 to the second bend line 150 defines a height of the back fold 144. In various embodiments, the height of the back fold 144 is less than or equal to the height of the outer box 102. In various embodiments, the dimensions of the top fold 142, back fold 144, and bottom fold 146 may be varied to accommodate various outer boxes 102 having various dimensions.

In various embodiments, the nested insulated packaging assembly 100 also includes the second thermal liner 108. In various embodiments, the second thermal liner 108 includes a top side end 232, a bottom side end 234, a left side end 236 and a right side end 238. As shown in FIG. 1, the second thermal liner 108 defines an outer surface 239 and an inner surface 241 between the ends 232,234,236,238. The second thermal liner 108 includes a left fold 152 defined between the left side end 236 and a third bend line 158, a front fold 154 defined between the third bend line 158 and a fourth bend line 160, and a right fold 156 defined between the fourth bend line 160 and the right side end 238 in various embodiments. In various embodiments, the left fold 152 is foldable relative to the front fold 154 at the third bend line 158 and the right fold 156 is foldable relative to the front fold 154 at the fourth bend line 160.

The second thermal liner 108 is used to wrap the contents of the outer box horizontally and line the left lateral side wall 120, front lateral side wall 116, and right lateral side wall 122 of the outer box 102. In various embodiments when the second thermal liner 108 is positioned in the outer box 102, the inner surface 241 faces the contents in the outer storage cavity 134 of the outer box 102 and the outer surface 239 faces the left lateral side wall 120, front lateral side wall 116, and right lateral side wall 122 of the outer box 102. In various embodiments, the outer surface 239 may face any of the lateral side walls 116,118,120,122 as desired. A distance from the top end 232 to the bottom end 234 defines a height of the second thermal liner 108. In various embodiments, the height of the second thermal liner 108 is less than or equal to the height of the back fold 144 of the first thermal liner 106. In various embodiments, the dimensions of the left fold 152, front fold 154, and right fold 156 may be varied to accommodate various outer boxes 102 having various dimensions.

In various embodiments, the first thermal liner 106 and the second thermal liner 108 are C-shaped when folded. In various embodiments, the first thermal liner 106 is C-shaped by folding the top fold 142 and the bottom fold 146 in the same direction relative to the back fold 144. In various embodiments, the second thermal liner 108 is C-shaped by folding the left fold 152 and the right fold 156 in the same direction relative to the front fold 154. However, the shape of the folded liners 106,108 should not be considered limiting on the current disclosure as in various other embodiments, the folded liners 106, 108 may have any desired shape. In various embodiments, the first thermal liner 106 and the second thermal liner 108 provide both cushioning and climate control to provide cushioned protection for the contents of the outer box 102 and maintain a temperature within the outer box 102. In various embodiments, the thermal liners 106,108 may include materials including, but not limited to, polyester film, such as polyethylene terephthalate (PET) film, foams, pellets, fabrics, nonwovens, polyethylene, polyurethane, polypropylene, and various other materials that may contribute towards a cushioned and climate controlled protective layer in the nested insulated packaging assembly 100. In various embodiments, the thermal liners 106,108 are biodegradable. In various embodiments, the thermal liners 106,108 are compostable. In various embodiments, the thermal liners are R-4 polyencapsulated thermal 100% recycled cotton liners. In various embodiments, the nested insulated packaging assembly 100 includes the outer box 102, first thermal liner 106, and second thermal liner 108.

The nested insulated packaging assembly 100 also includes the inner box 104 in various embodiments; however, in various other embodiments, the inner box 104 is omitted from the nested insulated packaging assembly 100. The inner box 104 includes a top end 162, a bottom end 164, a front lateral side wall 166, a back lateral side wall 168, a left lateral side wall 170, and a right lateral side wall 172. The front lateral side wall 166 includes an inner surface (not shown) and an outer surface 174. The back lateral side wall 168 includes an inner surface 176 and an outer surface (not shown). The left lateral side wall 170 defines an inner surface (not shown) and an outer surface 178. The right lateral side wall 172 defines an inner surface 180 and an outer surface (not shown). The inner surfaces of the lateral side walls 166,168,170,172 define an inner storage cavity 182. The lateral side walls 166,168,170,172 define an inner box top opening 184 at the top end 162 of the inner box 104.

Figure 4:
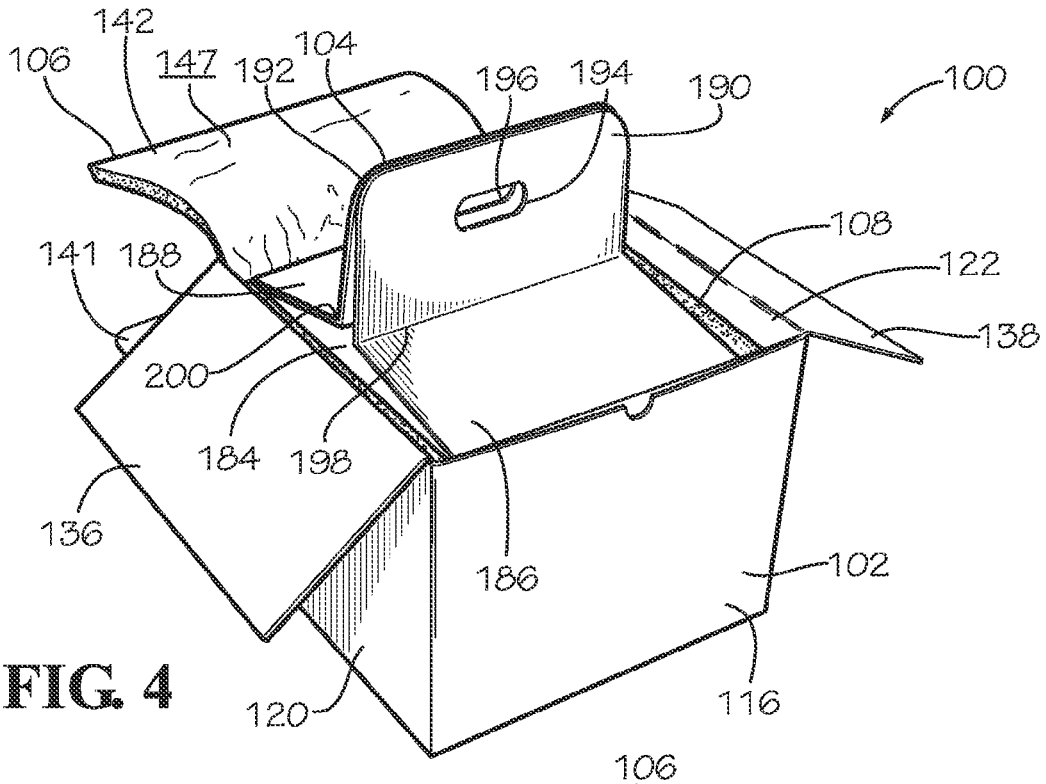
FIG. 4 is a perspective view of the nested insulated packaging of FIG. 1 showing how the inner box is positioned in the outer box with the thermal liners and with handles of the inner box projecting upwards.

As shown in FIG. 1, in the present embodiment, the inner box 104 includes a back flap 186 connected to the back lateral side wall 168 and a front flap 188 connected to the front lateral side wall 166 at the top end 162. The flaps 186,188 may be used to close the inner box top opening 184. When closed, the back flap 186 and front flap 188 define a top side wall of the inner box 104. In various embodiments, the inner box 104 includes a bottom left flap 220 at the bottom end 164 of the left lateral side wall 170 and a bottom right flap 222 at the bottom end 164 of the right lateral side wall 172. When closed, the bottom left flap 220 and bottom right flap 222 define a bottom side wall of the inner box 104. As shown in FIG. 1, in various embodiments, the back flap 186 includes a first handle panel 190 bendable along a back bend line 198 and defining a first handle 194. In various embodiments, the front flap 188 includes a second handle panel 192 bendable along a front bend line 200 and defining a second handle 196. In various embodiments, the handle panels 190,192 are folded along the respective bend lines 198,200 such that the handle panels 190,192 project upwards from the inner box 104, as shown in FIG. 4. In various embodiments, the handle panels 190,192 are in facing or near-facing contact when the handle panels 190, 192 project upwards from the inner box 104. In various embodiments, the handles 194,196 are aligned when the handle panels 190,192 project upwards from the inner box 104.

The location, shape, or number of flaps or handles with the inner box 104 should not be considered limiting on the current disclosure. For example, in various other embodiments, each lateral side wall 166,168,170,172 includes a flap at the top end 162 of the inner box 104. In various embodiments, the inner box 104 also includes bottom flaps at each lateral side wall 166,168,170,172 at the bottom end 164. In various embodiments, any of the flaps on the inner box 104 may be integral with the inner box 104 or connected to the inner box 104. In various embodiments, any of the flaps on the inner box 104 may include connecting mechanisms such as slats, snaps, adhesive, hooks and loops, and any other connecting mechanisms for selectively holding the flaps in place when the inner box top opening 184 is closed. In various embodiments, the handle panels 190,192 may be integral with the inner box 104 or connected to the inner box 104 through the flaps 186,188. In various embodiments, the handles 194,196 are formed integral with the handle panels 190,192 or connected to the handle panels 190,192 through connecting mechanisms including, but not limited to, slats, snaps, adhesive, hooks and loops, stitching, and any other connecting mechanisms. In addition, the number of side walls of the inner box 104 should not be considered limiting on the current disclosure. In various embodiments, the inner box 104 includes the top side wall, the bottom side wall, and at least one lateral side wall. For example, in various embodiments, the inner box 104 may be a cylindrically shaped box with a plurality of side walls curved into a cylindrical shape, where each side wall is a portion of the curved cylindrical perimeter of the box, such as where each side wall is a quarter portion of the perimeter, a half portion of the perimeter, or a third portion of the perimeter, or where one side wall is a third portion of the perimeter and one side wall is a two-thirds portion of the perimeter.

In various embodiments, the nested insulated packaging assembly 100 includes the divider 110; however, in various other embodiments, the divider 110 may be omitted from the nested insulated packaging assembly 100. In various embodiments, the nested insulated packaging assembly 100 includes the outer box 102, first thermal liner 106, second thermal liner 108, and divider 110. The divider 110 includes a front side 202, a back side 204, a left side 206, a right side 208, a top side 210, and a bottom side (not shown). In various embodiments, the sides 202,204,206,208 define a divider shape such that the divider 110 is insertable into the inner storage cavity 182 of the inner box 104. As shown in FIG. 1, in various embodiments, the divider 110 includes at least one vent opening 214 through the divider 110. In the present embodiment, the divider 110 includes six vent openings 214 centrally positioned on the divider 110; however, the number, shape, or location of vent openings 214 on the divider 110 should not be considered limiting on the current disclosure. In various embodiments, the vent opening 214 enables and regulates fluid flow through the divider 110. In various other embodiments, the divider 110 may include various other mechanisms for enabling and regulating fluid flow through the divider 110 such as various perforations, slits, slots, or various other similar mechanisms. In various embodiments, the divider 110 may not have any vent openings 214 or otherwise prevent fluid flow through the divider 110.

In various embodiments, the divider 110 may include an anchoring mechanism for securing a refrigerant on the divider 110 in the upper chamber 700, the lower chamber 702, or in both chambers 700,702. In various embodiments, the anchoring mechanism may be a strap, panels, slat, hook and loop connectors, adhesives, or various other anchoring mechanisms for securing a refrigerant on the divider 110.

Figure 2:
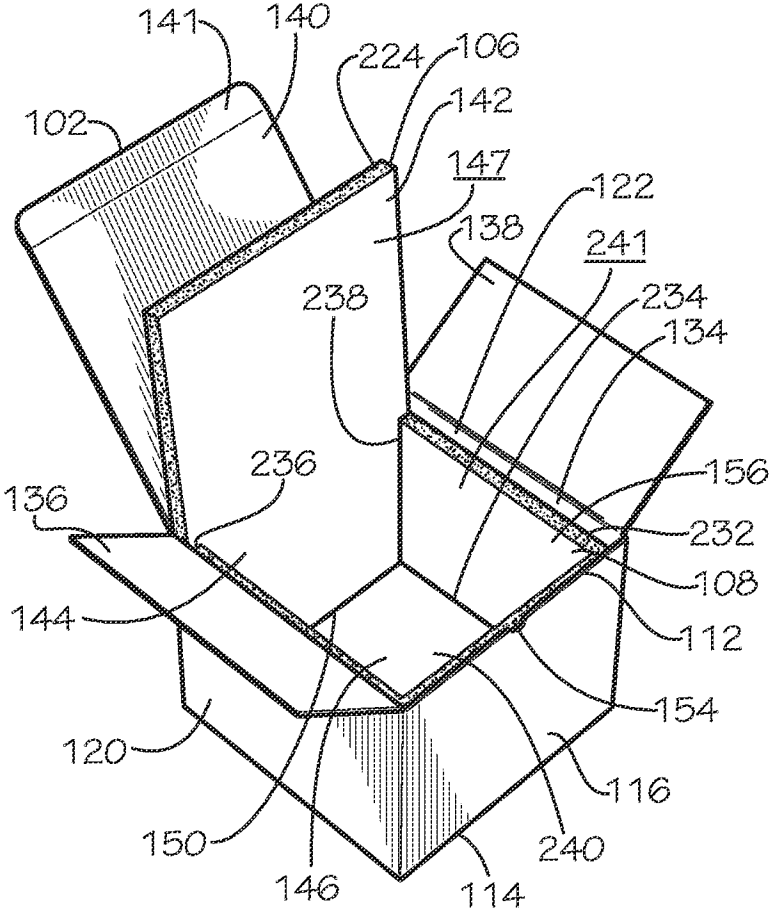
FIG. 2 is a perspective view of the first thermal liner, second thermal liner, and outer box of FIG. 1 with the first thermal liner and second thermal liner positioned in the outer box.
Figure 7:
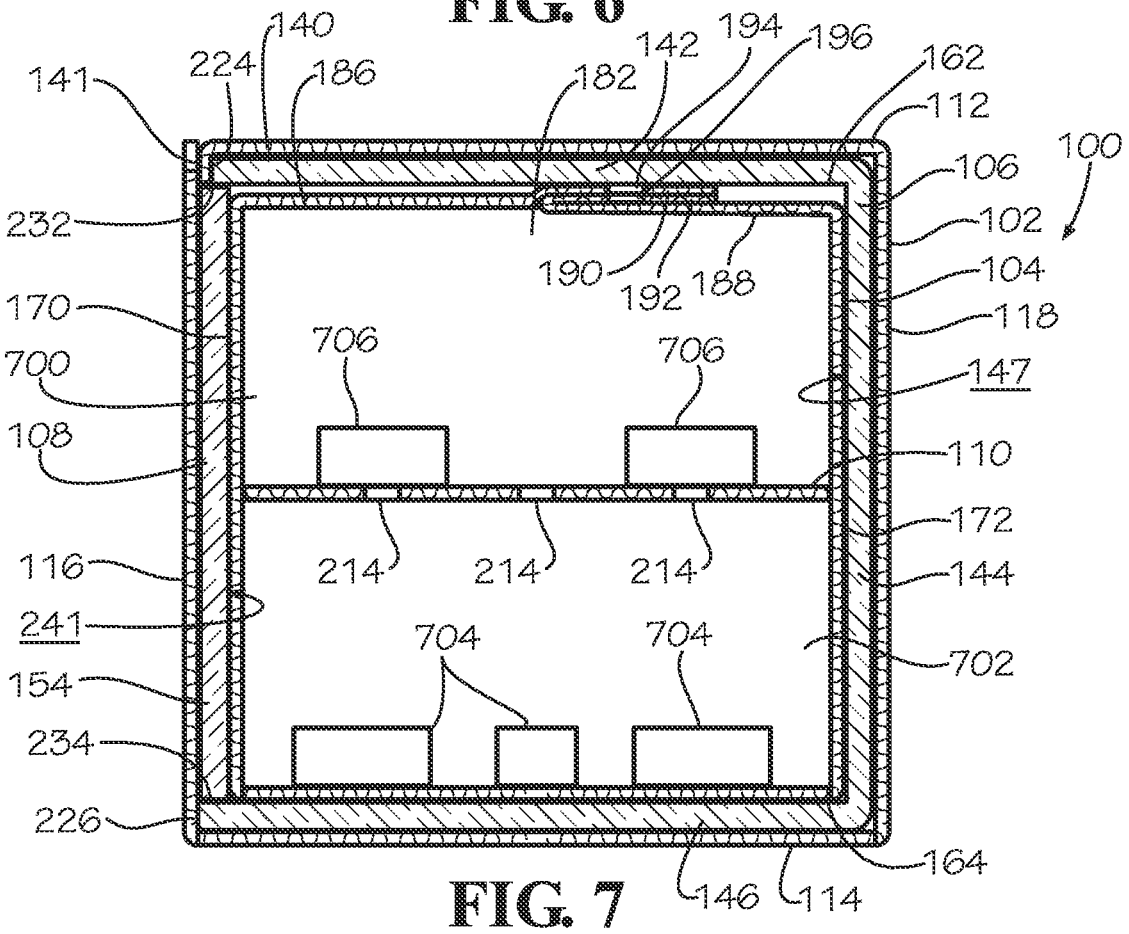
FIG. 7 is a sectional view of the nested insulated packaging of FIG. 6 taken along line 7-7 in FIG. 6.

FIG. 2 shows the outer box 102 with the first thermal liner 106 and second thermal liner 108 positioned in the outer storage cavity 134 of the outer box 102. As shown in FIG. 2, the first thermal liner 106 lines the bottom flaps at the bottom end 114 and the back lateral side wall 118 of the outer box 102 and the second thermal liner 108 lines the left lateral side wall 120, front lateral side wall 116, and right lateral side wall 122 of the outer box 102. In various embodiments, as shown in FIG. 7, the second thermal liner 108 is positioned in the outer box 102 with the first thermal liner 106 such that the bottom end 234 of the second thermal liner 108 contacts the inner surface 147 of the first thermal liner 106 on the bottom fold 146 of the first thermal liner 106 and the left side end 236 and the right side end 238 of the second thermal liner 108 contact the inner surface 147 of the first thermal liner 106 on the back fold 144 of the first thermal liner 106. When the nested insulated packaging assembly 100 is closed, as shown in FIG. 7, the top end 232 of the second thermal liner 108 contacts the inner surface 147 of the first thermal liner 106 on the top fold 142 of the first thermal liner 106. When the box 102 is closed, the first thermal liner 106 also lines the back flap 140 at the top end 112 of the outer box 102. As shown in FIG. 2, the height of the outer box 102 is greater than or equal to the height of the back fold 144 of the first thermal liner 106 and the height of the back fold 144 of the first thermal liner 106 is greater than or equal to the height of the second thermal liner 108. In various embodiments, an insulated cavity 240 is defined by the first thermal liner 106 and second thermal liner 108 lining the outer box 102. The insulated cavity 240 is cushioned and maintains a temperature within the outer box 102.

Figure 3:
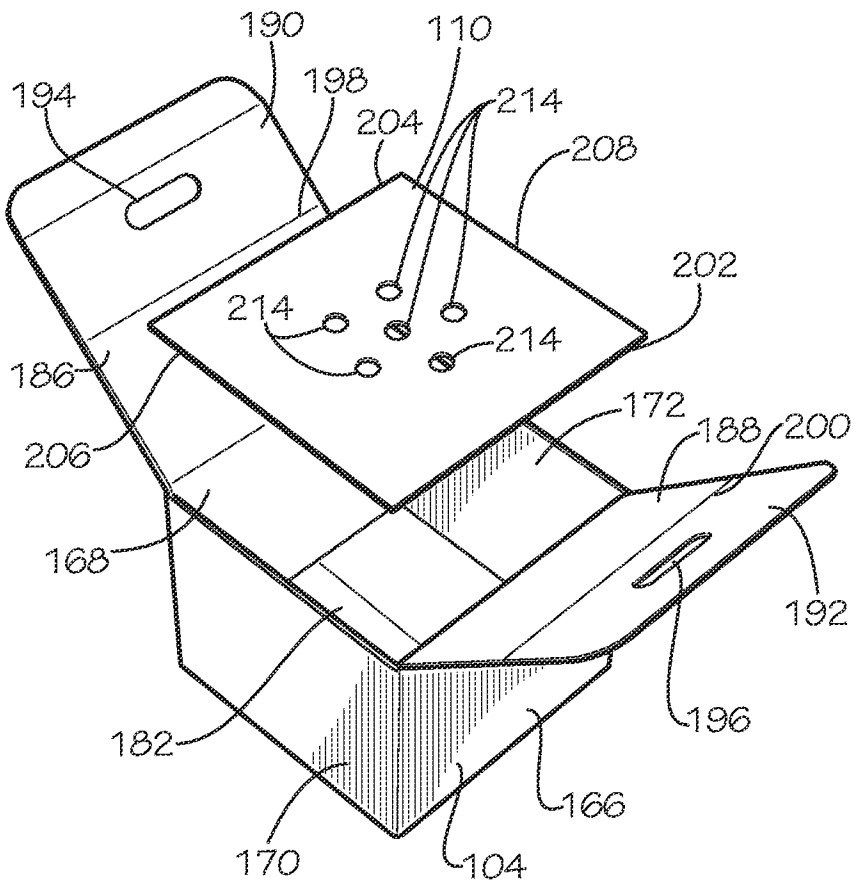
FIG. 3 is an exploded view of the inner box and pad of FIG. 1.

FIG. 3 shows the inner box 104 and divider 110. As shown in FIG. 3, the sides 202,204,206,208 define a shape of the divider 110 such that the divider 110 is insertable into the inner storage cavity 182 of the inner box 104 in the horizontal orientation shown in FIG. 3 and the divider 110 is housed within the inner box 104.

FIG. 4 shows the inner box 104 inserted into the insulated cavity 240 formed by the first thermal liner 106 and the second thermal liner 108 when the liners 106,108 are positioned in the outer box 102. In various embodiments, the inner box 104 is inserted into the insulated cavity 240 such that the front lateral side wall 166 is aligned with the front lateral side wall 116 of the outer box 102, the back lateral side wall 168 is aligned with the back lateral side wall 118 of the outer box 102, the left lateral side wall 170 is aligned with the left lateral side wall 120 of the outer box 102, and the right lateral side wall 172 is aligned with the right lateral side wall 122 of the outer box 102; however, this alignment should not be considered limiting on the current disclosure as in various other embodiments, the lateral side walls 166,168,170,172 may have any desired alignment relative to the lateral side walls 116,118,120,122 of the outer box 102. When the inner box 104 is positioned in the insulated cavity 240, one outer surface is in contact with the inner surface 147 of the first thermal liner 106 on the back fold 144 of the first thermal liner 106 and the remaining outer surfaces of the side walls 166,168,170,172 of the inner box 104 are in contact with the inner surface 241 of the second thermal liner 108. In various embodiments, the inner surface 147 of the first thermal liner 106 and the inner surface 241 of the second thermal liner 108 are in contact with the inner box 104 and the outer surface 145 of the first thermal liner 106 and the outer surface 239 of the second thermal liner 108 are in contact with the outer box 102.

As shown in FIG. 4, in various embodiments, the first handle panel 190 is bent along the back bend line 198 such that the first handle panel 190 projects upwards from the inner box 104. In various embodiments, the second handle panel 192 is bent along the front bend line 200 such that the second handle panel 192 projects upwards from the inner box 104. In various embodiments, both handle panels 190, 192 are bent along bend lines 198,200 and project upwards from the inner box 104. When both handle panels 190,192 project upwards, in various embodiments, the first handle 194 may align with the second handle 196. In various embodiments, the handle panels 190,192 projecting upwards enable a user to more easily grab the inner box 104 through the first handle 194, second handle 196, or both handles 194,196 and remove the inner box 104 from the insulated cavity 240.

Figure 5:
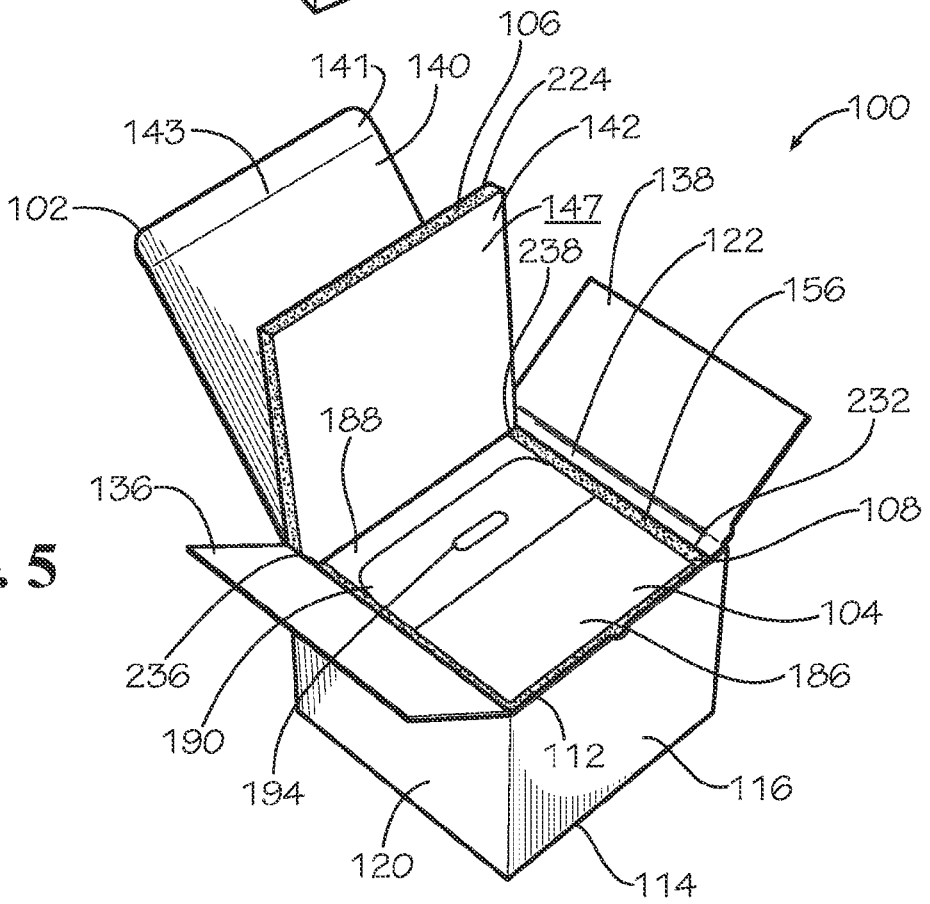
FIG. 5 is a perspective view of the nested insulated packaging of FIG. 1 with handles of the inner box folded so the outer box may be closed.

FIG. 5 shows the inner box 104 inserted into the insulated cavity 240 with the handle panels 190,192 in a collapsed position which blocks the inner box top opening 184. As partially shown in FIG. 5, in various embodiments, in the collapsed position, the back flap 186 and first handle panel 190 are folded over the front flap 188 and second handle panel 192 such that the back flap 186, first handle panel 190, front flap 188, and second handle panel 192 are orthogonal to the lateral side walls 116,118,120,122 of the outer box 102. In various other embodiments, the flaps 186,188 and handle panels 190,192 may be folded at an angle other than orthogonal. In various other embodiments, the front flap 188 and second handle panel 192 may be folded over the back flap 186 and first handle panel 190. In various other embodiments, the flaps 186,188 and/or panels 190,192 may be folded in any configuration suitable to block the inner box top opening 184.

Figure 6:
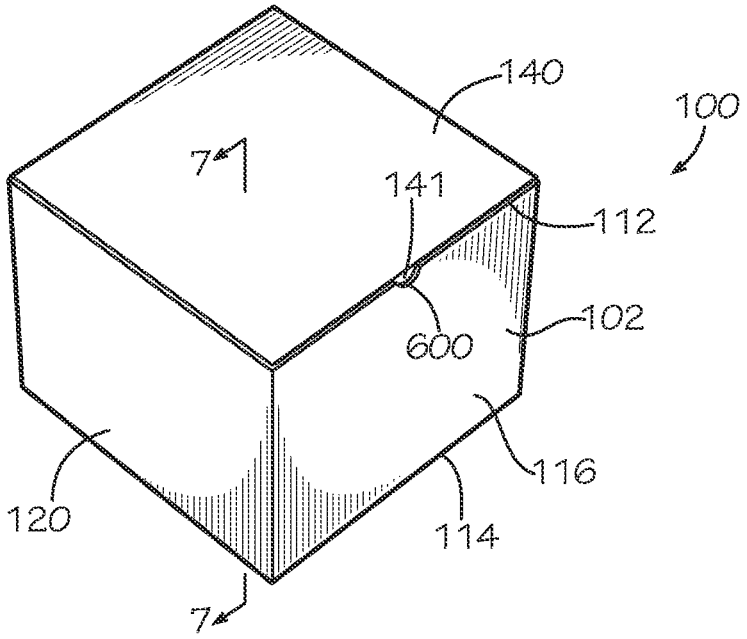
FIG. 6 is a perspective view of the nested insulated packaging of FIG. 1 with the outer box closed.

FIG. 6 shows the nested insulated packaging assembly 100 fully closed. When the nested insulated packaging assembly 100 is fully closed, the back flap 140 is folded to cover the top opening 124 of the outer storage cavity 134. In various embodiments, the locking panel 141 is inserted into the outer storage cavity 134 to help secure the back flap 140 closed. The fully closed nested insulated packaging assembly 100 may be self-sealing in various embodiments. In various other embodiments, the nested insulated packaging assembly 100 may utilize sealers such as various adhesives, glues, tapes, hook and loop connectors, and various other connecting mechanisms. As shown in FIG. 6, in various embodiments, a notch 600 is defined in the front lateral side wall 116 at the top end 112. In various embodiments, the notch 600 enables a user to access the locking panel 141.

In the current embodiment, the first thermal liner 106 contacts the outer box 102 at the bottom side wall of the outer box 102 formed by flaps 216,218, the back lateral side wall 118, and the top side wall of the outer box 102 formed by flaps 136,138,140. In the current embodiment, the first thermal liner 106 also contacts the inner box 104 at the bottom side wall of the inner box 104 formed by flaps 220,222, the back lateral side wall 168, and the top side wall of the inner box formed by flaps 186,188. In the current embodiment, the second thermal liner 108 contacts the outer box 102 at the left lateral side wall 120, front lateral side wall 116, and right lateral side wall 122. In the current embodiment, the second thermal liner 108 also contacts the inner box 104 at the left lateral side wall 170, the front lateral side wall 166, and the right lateral side wall 172. In various other embodiments, the liners 106,108 may have any desired configuration such that together, the liners 106,108 contact the respective side walls of the outer box 102 and inner box 104. The respective contact between the first thermal liner 106, second thermal liner 108, outer box 102, and inner box 104 is partially shown in FIG. 7.

FIG. 7 shows a cross-sectional view of the nested insulated packaging assembly 100 taken along line 7-7 in FIG. 6. As shown in FIG. 7, when the nested insulated packaging assembly 100 is fully closed, the locking panel 141 connected to the back flap 140 is at least partially inserted into the outer storage cavity 134 such that the locking panel 141 is adjacent to the front lateral side wall 116. FIG. 7 also shows the back flap 186 and first handle panel 190 folded over the front flap 188 and second handle panel 192 such that the back flap 186, first handle panel 190, front flap 188, and second handle panel 192 are orthogonal to the side walls 170,172 of the inner box 104 in various embodiments.

In various embodiments, a user may desire to package items 704 at a first temperature in the nested insulated packaging assembly 100 and items 706 at a second temperature in the nested insulated packaging assembly 100. In various embodiments, the items 704 and items 706 may be various perishable items, pharmaceuticals, other temperature sensitive items, or other items to be shipped such as boxes of food, bottles of beverages, bagged fruits, bagged vegetables, and various other items. As shown in FIG. 7, the divider 110 is positioned in the inner storage cavity 182 of the inner box 104. The divider 110 divides the inner storage cavity 182 into an upper chamber 700 and a lower chamber 702. In various embodiments, the divider 110 may be mounted in the inner box 104 through various connecting mechanisms such as adhesives and glues, positioned on a ledge or flap of the inner surface of the inner box 104, rest on top of the items 704 in the lower chamber, or otherwise be positioned in the inner storage cavity 182 dividing the inner storage cavity into the upper chamber 700 and lower chamber 702.

In various embodiments, a combination of the first thermal liner 106, second thermal liner 108, and divider 110 maintain the lower chamber 702 at a first temperature suitable for the items 704 and maintain the upper chamber 700 at a second temperature suitable for the items 706. In various embodiments, the upper chamber 700 is maintained at a temperature above the temperature of the lower chamber 702. As described above, in various embodiments, the divider 110 includes vent openings 214 enabling fluid flow, typically air flow in various embodiments, through the divider 110. In various embodiments, warm air present in the lower chamber 702 may be vented to the upper chamber 700 through the vent openings 214. Venting of the warm air to the upper chamber 700 may keep the lower chamber 702 at a colder temperature for a longer duration because the divider 110 isolates the two temperature chambers. In this manner, co-shipment of items requiring dual temperatures is enabled.

Each of the upper chamber 700 and the lower chamber 702 may have customized temperature profiles. In various embodiments, the size, shape, and number of vent openings 214 may regulate the air flow through the divider 110 at desired levels to achieve specific temperature profiles in each of the upper chamber 700 and the lower chamber 702. In various embodiments, the insulation properties of the first thermal liner 106, second thermal liner 108, outer box 102, inner box 104, and divider 110 are also utilized to achieve specific temperature profiles in each of the upper chamber 700 and the lower chamber 702. As shown in FIG. 7, in various embodiments, the inner box 104 provides a physical barrier between the items 704,706 to be shipped and the thermal liners 106,108. In these embodiments, the thermal liners 106,108 may not contact the items 704,706 and the wear on the thermal liners 106,108 from the items 704,706, such as tearing, moisture, dirt, and other types of wear, is reduced.

The temperature profiles in each of the upper chamber 700 and lower chamber 702 may be controlled through location of a refrigerant in the outer box 102, location of a refrigerant in the inner box 104, the vent openings 214, the composition of the divider 110, the shape of the divider 110, and the insulation properties of the first thermal liner 106, second thermal liner 108, outer box 102, inner box 104, and divider 110. In various embodiments, the refrigerant may be selected from the group including, but not limited to, ice packs, dry ice, gel packs, chilling units, water, and various other mechanisms for keeping items chilled. In various embodiments, these aspects of the nested insulated packaging assembly 100 may be varied to obtain desired temperature profiles in each of the upper chamber 700 and lower chamber 702.

Figure 8:
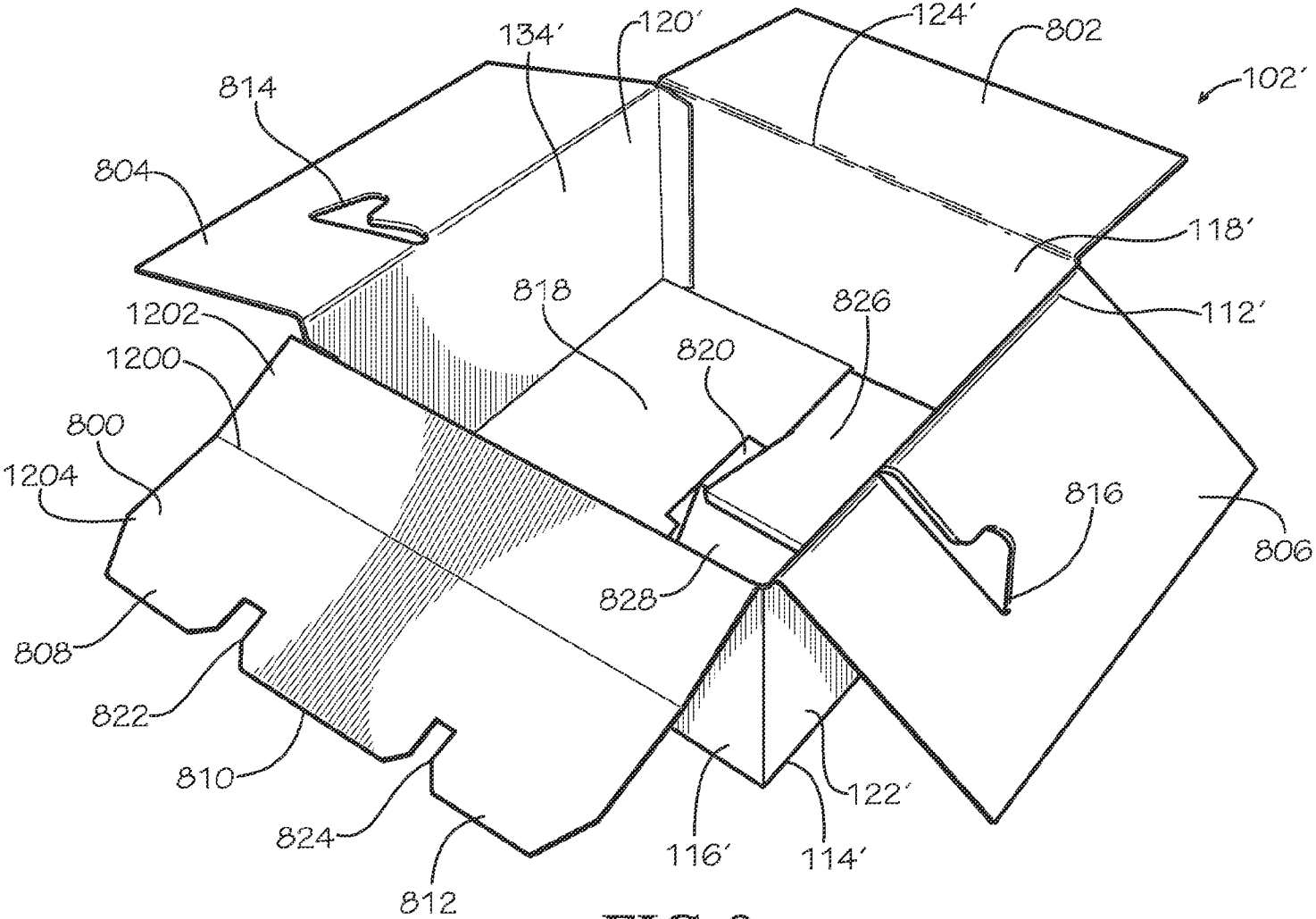
FIG. 8 is a perspective view of another embodiment of an outer box.

FIG. 8 shows another embodiment of an outer box 102'. In various embodiments, the outer box 102' is similar to the outer box 102 and includes a top end 112', a bottom end 114', a front lateral side wall 116', a back lateral side wall 118', a left lateral side wall 120', and a right lateral side wall 122'. The lateral side walls 116',118',120',122' define a top opening 124' at the top end 112' of the outer box 102'. In various embodiments, the top opening 124' provides access to an outer storage cavity 134' defined by the outer box 102'.

As shown in FIG. 8, the outer box 102' includes a front locking flap 800 at the top end 112' of the front lateral side wall 116', a back locking flap 802 at the top end 112' of the outer box 102' at the back lateral side wall 118', a left locking flap 804 at the top end 112' of the outer box 102' at the left lateral side wall 120', and a right locking flap 806 at the top end 112' of the outer box 102' at the right lateral side wall 120'. In various embodiments, a bend line 1200 may separate the front locking flap 800 into a base panel 1202 and a locking panel 1204. When closed, the locking flaps 800,802,804,806 define a top side wall of the outer box 102'. In various embodiments, the outer box 102' also includes a front bottom locking flap 828 at the bottom end 114' of the outer box 102' at the front lateral side wall 116', a back bottom locking flap 826 at the bottom end 114' of the outer box 102' at the back lateral side wall 118', a left bottom locking flap 818 at the bottom end 114' of the outer box 102' at the left lateral side wall 120', and a right bottom locking flap 820 at the bottom end 114' of the outer box 102' at the right lateral side wall 120'. When closed, the locking flaps 818,820,826,828 define a bottom side wall of the outer box 102'. The number, shape, or location of locking flaps on the outer box 102' should not be considered limiting on the current disclosure as in various embodiments, the outer box 102' may have any desired number, shape, or location of locking flaps.

As shown in FIG. 8, in various embodiments, the locking flaps 800,802,804,806 of the outer box 102' in combination form a self-sealing mechanism. In various embodiments, the self-sealing mechanism enables the outer box 102' to be closed and secured without additional sealing mechanisms such as tapes, glues, adhesives, and various other similar mechanisms. In various embodiments, the self-sealing mechanism includes a left locking tab 808, a center locking tab 810, and a right locking tab 812 defined on the front locking flap 800. As shown in FIG. 8, in various embodiments the self-sealing mechanism also includes a first locking slot 822 on the front locking flap 800 between the left locking tab 808 and the center locking tab 810. In various embodiments, the self-sealing mechanism also includes a second locking slot 824 defined on the front locking flap 800 between the center locking tab 810 and the right locking tab 812. Although a self-sealing mechanism with three locking tabs 808,810,812 and two locking slots 822,824 on the front locking flap 800 is shown in the current embodiment, the number of locking tabs or locking slots on the front locking flap 800 should not be considered limiting on the current embodiment. As shown in FIG. 8, in various embodiments, self-sealing mechanism also includes a left flap locking slot 814 defined on the left top locking flap 804 and a right flap locking slot 816 defined on the right top locking flap 806. In various embodiments, the flap locking slots 814,816 are L-shaped; however, the shape of the flap locking slots 814,816 should not be considered limiting on the current disclosure as in various other embodiments, the flap locking slots 814,816 may have any desired shape. The number of locking slots on the left locking flap 804 or right locking flap 806 should also not be considered limiting on the current disclosure.

Figure 9:
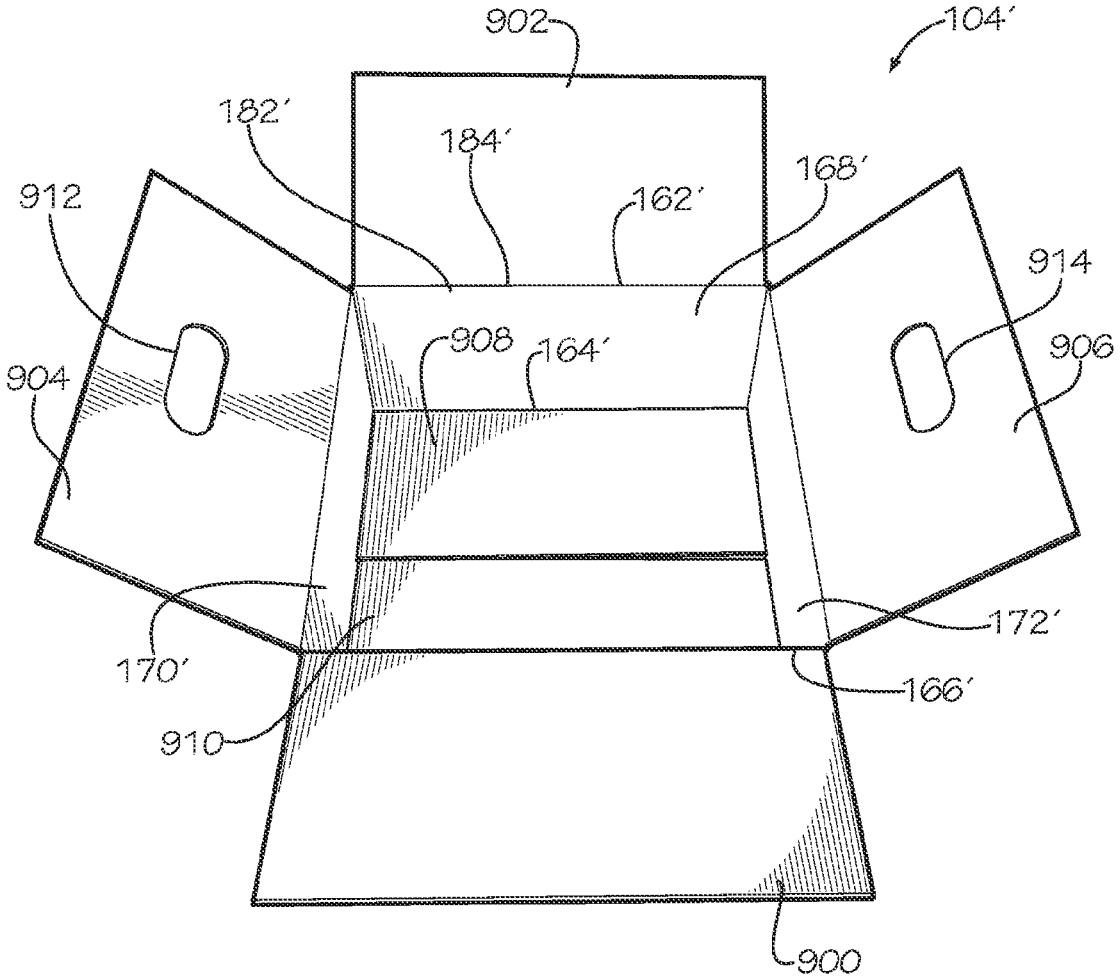
FIG. 9 is a perspective view of another embodiment of an inner box.

FIG. 9 shows another embodiment of an inner box 104'. In various embodiments, the inner box 104' is similar to inner box 104 and includes a top end 162', a bottom end 164', a front lateral side wall 166', a back lateral side wall 168', a left lateral side wall 170', and a right lateral side wall 172'. The inner surfaces of the lateral side walls 166',168',170', 172' define an inner storage cavity 182'. The lateral side walls 166',168',170',172' define an inner box top opening 184' at the top end 162' of the inner box 104'.

As shown in FIG. 9, the inner box 104' includes a front flap 900 connected to the front lateral side wall 166' at the top end 162', a back flap 902 connected to the back lateral side wall 168' at the top end 162', a left flap 904 connected to the left lateral side wall 170' at the top end 162', and a right flap 906 connected to the right lateral side wall 172' at the top end 162'. When closed, the flaps 900,902,904,906 define a top side wall of the inner box 104'. In various embodiments, the inner box 104' also includes a back bottom flap 908 connected to the back lateral side wall 168' at the bottom end 164' and a front bottom flap 910 connected to the front lateral side wall 166' at the bottom end 164'. When closed, the flaps 908,910 define a bottom side wall of the inner box 104'. The shape, location, or number of flaps should not be considered limiting on the current disclosure.

As shown in FIG. 9, in various embodiments, the left flap 904 defines a left handle opening 912 and the right flap 906 defines a right handle opening 914. In various embodiments, a user may grab the left handle opening 912, right handle opening 914, or both handle openings 912,914 to aid in handling the inner box 104'. The location, shape, and number of handle openings should not be considered limiting on the current embodiment as in various other embodiments, a handle opening may be defined in any of the flaps 900,902, 904,906 or none of the flaps 900,902,904,906.

Figure 10:
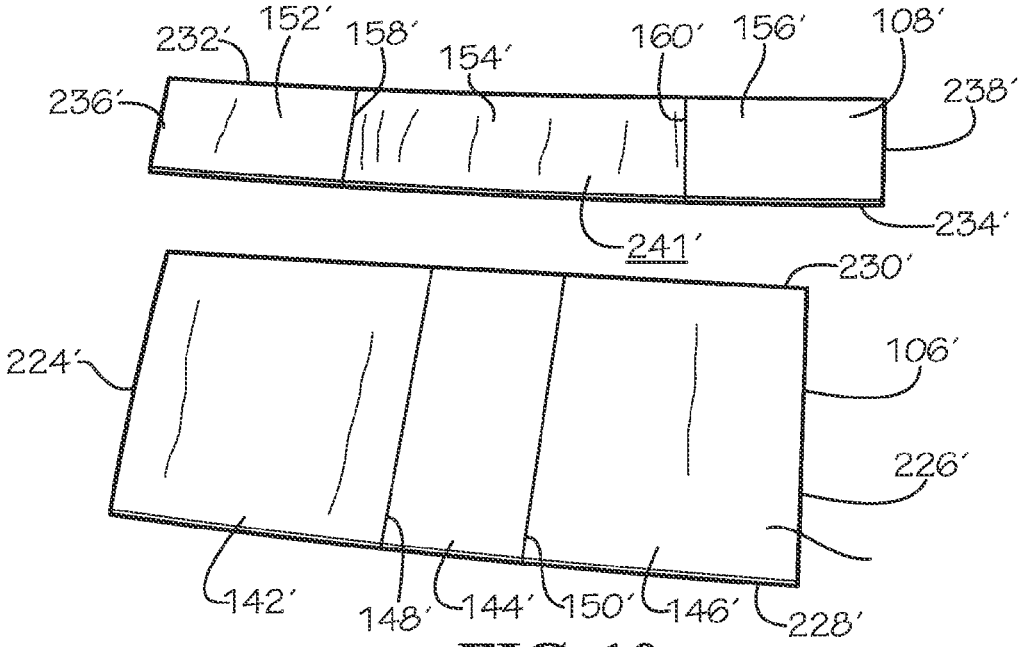
FIG. 10 is a top view of another embodiment of the first thermal liner and the second thermal liner.

FIG. 10 shows another embodiment of a first thermal liner 106' and a second thermal liner 108'. In various embodiments, the first thermal liner 106' is similar to the first thermal liner 106 and includes a top end 224', a bottom end 226', a left side end 228', and a right side end 230'. As shown in FIG. 10, the first thermal liner 106' defines an inner surface 147' and an outer surface (not shown) between the ends 224',226',228',230'. In various embodiments, the first thermal liner 106' includes a top fold 142' defined between the top end 224' and a first bend line 148', a back fold 144' defined between the first bend line 148' and a second bend line 150', and a bottom fold 146' defined between the bend line 150' and the bottom end 226'. In various embodiments, the second thermal liner 108' is similar to the second thermal liner 108 and includes a top side end 232', a bottom side end 234', a left side end 236', and a right side end 238'. As shown in FIG. 10, the second thermal liner 108' defines an inner surface 241' and an outer surface (not shown) between the ends 232',234',236',238'. The second thermal liner 108' includes a left fold 152' defined between the left side end 236' and a third bend line 158', a front fold 154' defined between the third bend line 158' and a fourth bend line 160', and a right fold 156' defined between the fourth bend line 160' and the right side end 238' in various embodiments.

As shown in FIG. 10, in various embodiments, a distance from the first bend line 148' to the second bend line 150' on the first thermal liner 106', which is the height of the back fold 144', is greater than a distance from the bottom side end 234' to the top side end 232' of the second thermal liner 108', which is the height of the second thermal liner 108'.

Figure 11:
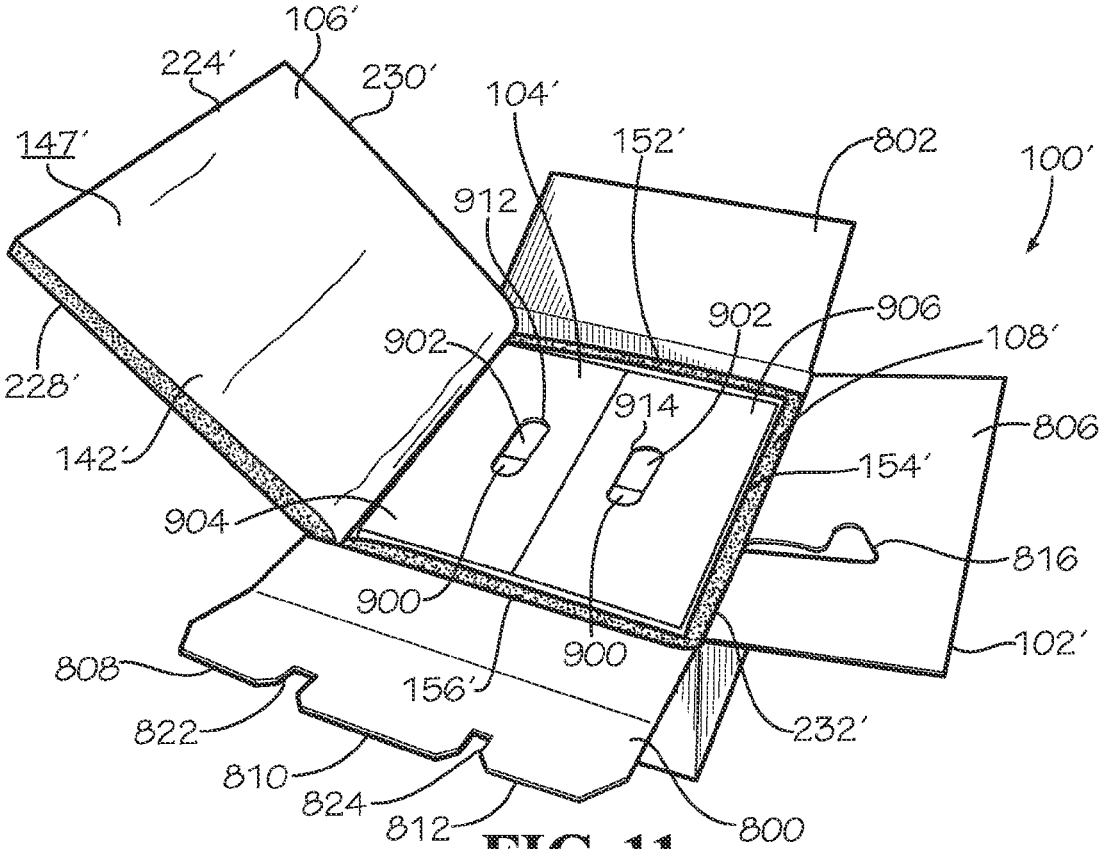
FIG. 11 is a perspective view of the outer box of FIG. 10, the inner box of FIG. 9, and the thermal liners of FIG. 10 showing how the thermal liners and inner box are positioned in the outer box.
Figure 12:
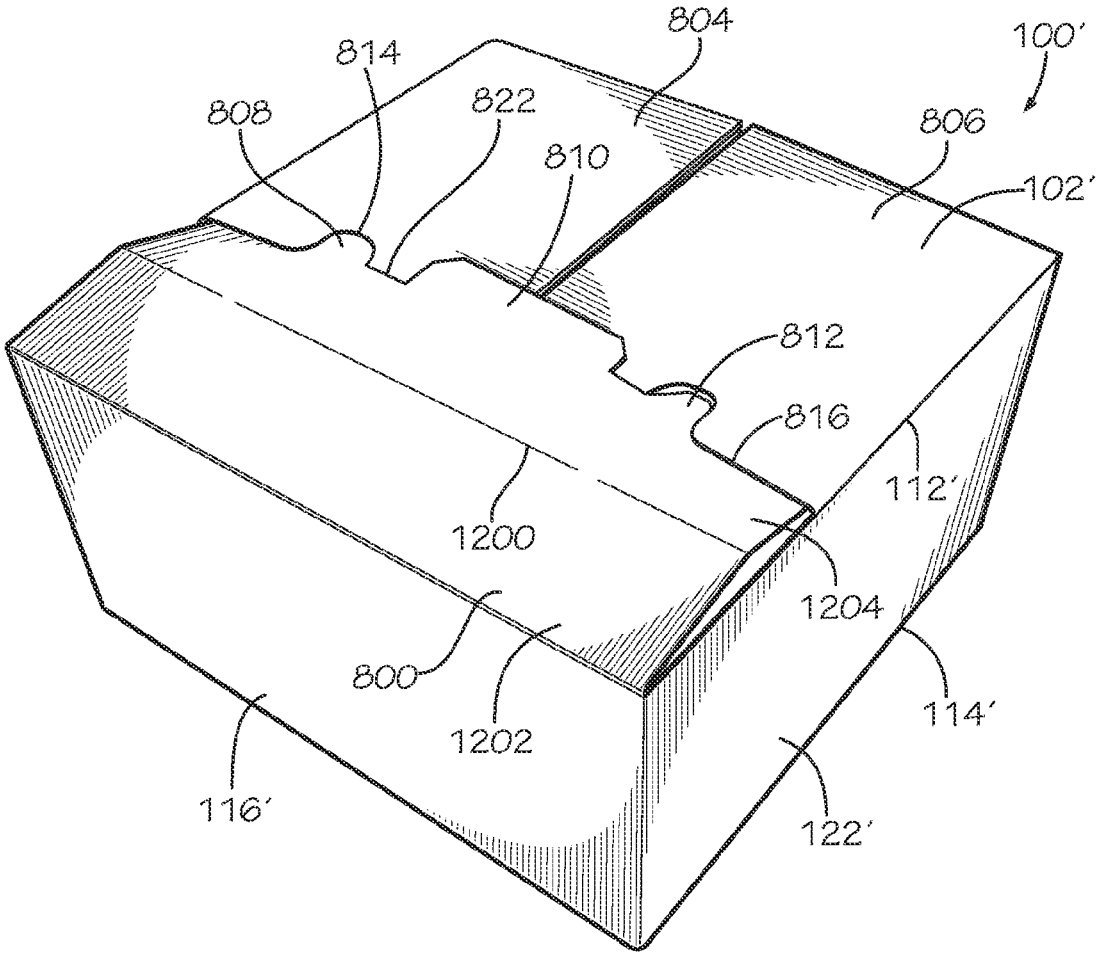
FIG. 12 is a perspective view of the outer box of FIG. 10 in a closed position.

FIG. 11 shows another embodiment of nested insulated packaging assembly 100' with the thermal liners 106',108' shown in in FIG. 10 and the inner box 104' shown in FIG. 9 inserted into the outer box 102' shown in FIG. 8. FIG. 12 shows the nested insulated packaging assembly 100' with the outer box 102' closed and the locking flaps 800,804,806 engaged. In various embodiments, the self-sealing mechanism, including locking flaps 800,804,806, enable the nested insulated packaging assembly 100' to be self-sealing and secure the nested insulated packaging assembly 100' closed.

As shown in FIG. 12, in various embodiments the self-sealing mechanism includes the bend line 1200 defined on the front locking flap 800. The bend line 1200 may separate the front locking flap 800 into the base panel 1202 and the locking panel 1204. In various embodiments, the locking panel 1204 is bent relative to the base panel 1202 along bend line 1200. In various embodiments, the bending of the locking panel 1204 permits the left locking tab 808 of the front locking flap 800 to be inserted into the left locking slot 814 of the left flap 804. The bending also permits the right locking tab 812 of the front locking flap 800 to be inserted into the right locking slot 816 of the right flap 806. As shown in FIG. 12, in various embodiments, the center locking tab 810 is positioned over the flaps 804,806 when the left locking tab 808 is inserted into the left locking slot 814 and the right locking tab 812 is inserted into the right locking slot 816. In this manner, the tabs 808,810,812 lock the front locking flap 800 with the side flaps 804,806 and lock the nested insulated packaging assembly 100'. In various embodiments, the center tab 810 holds the side flaps 804,806 down and the left tab 808 and right tab 812 hold the front locking flap 800 down.

A method of assembling the nested insulated packaging assembly 100 is also disclosed. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure. The outer box 102 having the outer storage cavity 134 is provided.

The first thermal liner 106 is positioned in outer storage cavity 134 of the outer box 102 such that the bottom fold 146 contacts a bottom side of the box, the back fold 144 contacts one of the lateral side walls, such as the back lateral side wall 118, of the outer box 102, and the top fold 142 contacts a top side of the outer box 102 when closed such that the top fold 142 covers the top opening 124 of the outer storage cavity 134. The second thermal liner 108 is positioned in the outer storage cavity 134 of the outer box 102 such that the second thermal liner 108 contacts three of the lateral side walls of the outer box 102, such as the left lateral side wall 120, right lateral side wall 122, and front lateral side wall 116. The second thermal liner 108 is positioned in various embodiments such that the bottom end 234 contacts and rests on the inner surface 147 of the first thermal liner 106 on the bottom fold 146 of the first thermal liner 106, the left side end 236 and right side end 238 contacts the inner surface 147 of the first thermal liner 106 on the back fold 144 of the first thermal liner 106, and the top end 234 contacts the inner surface 147 of the first thermal liner 106 on the top fold 142 when the top fold 142 is closed.

The first thermal liner 106 and second thermal liner 108 positioned in the outer storage cavity 134 define the insulated cavity 240. In various embodiments, the inner surface 147 of the first thermal liner 106 and the inner surface 241 of the second thermal liner 108 define the insulated cavity 240. In various embodiments, the inner box 104 is positioned in the insulated cavity 240. In various embodiments, the inner surfaces 147,241 contact the outer surfaces of all the side walls of the inner box 104 when the nested insulated packaging assembly 100 is closed.

In various embodiments, a user positions the items 704 in the inner storage cavity 182 of the inner box 104. The divider 110 is positioned in the inner storage cavity 182 over the items 704. The user positions items 706 in the inner storage cavity 182 of the inner box 104 on the divider 110. Insertion of the divider 110 in the inner storage cavity 182 separates the inner storage cavity 182 into the upper chamber 700, the portion of the inner storage cavity 182 and the top end 162 of the inner box 104, and the lower chamber 702, the portion of the inner storage cavity 182 and the bottom end 164 of the inner box 104. In various embodiments, vent openings 214 in the divider 110 permit warm air to rise from the lower chamber 702 into the upper chamber 700 and cool air to settle from the upper chamber 700 into the lower chamber 702. In various embodiments, the temperature maintained in the upper chamber 700 may be different from the temperature maintained in the lower chamber 702, permitting packaging of items that need to be stored at different temperatures.

In various embodiments, the nested insulated packaging assembly 100 enables a transporter or deliverer to transport items to be shipped, such as the items 704 and items 706, in the inner box 104 positioned in the outer box 102 and remove the inner box 104 for the end user while retaining the outer box 102 and thermal liners 106,108 for reuse. In various embodiments, the deliverer may reuse the outer box 102 and thermal liners 106,108 with other inner boxes 104 for other customers. The deliverer may also more reliably recycle the outer box 102 and thermal liners 106,108 after delivery of the inner box 104 for the end user.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A nested insulated packaging assembly comprising:

an outer box including an outer top side wall, an outer bottom side wall, and a plurality of outer lateral side walls, the outer top side wall disposed opposite from the outer bottom side wall, the plurality of outer lateral side walls disposed between the outer top side wall and the outer bottom side wall;

an inner box received in the outer box, the inner box including an inner top side wall, an inner bottom side wall, and a plurality of inner lateral side walls, the inner top side wall disposed opposite from the inner bottom side wall, the plurality of inner lateral side walls disposed between the inner top side wall and the inner bottom side wall, the inner top side wall defining a top outer surface, the top outer surface comprising a first material, the plurality of inner lateral side walls defining a lateral outer surface and a lateral inner surface, the lateral inner surface disposed opposite from the lateral outer surface, the lateral inner surface at least partially defining an inner storage cavity within the inner box, the lateral outer surface and the lateral inner surface each comprising the first material;

a first thermal liner defining a first outer surface and a first inner surface, the first outer surface defined opposite from the first inner surface, the first thermal liner comprising a top fold, a back fold, and a bottom fold, the top fold and the bottom fold folded relative to the back fold so that the first thermal liner is C-shaped, the first outer surface contacting a one of the outer lateral side walls, the outer bottom side wall, and the outer top side wall of the outer box, the first inner surface contacting the top outer surface, the first inner surface contacting the lateral outer surface at a one of the inner lateral side walls of the inner box; and a second thermal liner defining a second outer surface and a second inner surface, the second outer surface defined opposite from the second inner surface, the second thermal liner comprising a left fold, a front fold, and a right fold, the left fold and the right fold folded relative to the front fold so that the second thermal liner is C-shaped, the second outer surface contacting a second, a third, and a fourth of the outer lateral side walls of the outer box, the second inner surface contacting the lateral outer surface at a second of the inner lateral side walls of the inner box.

2. The nested insulated packaging assembly of claim 1, wherein a portion of the first thermal liner covers the inner top side wall of the inner box.

3. The nested insulated packaging assembly of claim 1, wherein the top fold of the first thermal liner covers the inner top side wall of the inner box and covers a side end of the second thermal liner.

4. The nested insulated packaging assembly of claim 1, wherein the first thermal liner is foldable to move the first thermal liner away from the inner box to remove the inner box from the outer box.

5. The nested insulated packaging assembly of claim 1, wherein the second thermal liner rests on the bottom fold of the first thermal liner, and the bottom fold covers the outer bottom side wall of the outer box.

6. The nested insulated packaging assembly of claim 1, wherein a side end of the second thermal liner contacts the first inner surface at the back fold of the first thermal liner covering the one of the inner lateral side wall of the inner box.

7. The nested insulated packaging assembly of claim 1, further comprising a divider positioned in the inner storage cavity defined by the inner box, the divider defining an upper chamber in the inner storage cavity between the divider and the inner top side wall and defining a lower chamber in the inner storage cavity between the divider and the inner bottom side wall.

8. The nested insulated packaging assembly of claim 7, wherein the divider defines at least one vent opening extending through the divider, the at least one vent opening enabling fluid flow through the divider.

9. The nested insulated packaging assembly of claim 7, wherein the upper chamber has an upper chamber temperature and the lower chamber has a lower chamber temperature different from the upper chamber temperature.

10. The nested insulated packaging assembly of claim 1, wherein the outer top side wall of the outer box includes a first locking flap and a second locking flap, wherein the first locking flap defines a locking slot and the second locking flap defines a locking tab, the locking tab insertable into the locking slot for securing the outer top side wall closed.

11. The nested insulated packaging assembly of claim 1, wherein the inner top side wall includes a top flap defining a handle.

12. The nested insulated packaging assembly of claim 1, wherein:

the top fold is defined between a top end and a first bend line on the first thermal liner, the back fold is defined between the first bend line and a second bend line on the first thermal liner, and the bottom fold is defined between the second bend line and a bottom end of the first thermal liner; and the second thermal liner includes a top side end, a bottom side end, a left side end, and a right side end.

13. The nested insulated packaging assembly of claim 12, wherein:

the bottom side end of the second thermal liner contacts the first inner surface at the bottom fold of the first thermal liner;

the left side end and the right side end of the second thermal liner contact the first inner surface at the back fold of the first thermal liner; and the top side end of the second thermal liner contacts the first inner surface at the top fold of the first thermal liner.

14. The nested insulated packaging assembly of claim 1, wherein the first inner surface of the first thermal liner covers the inner top side wall and the inner bottom side wall, and the second inner surface of the second thermal liner covers a third and fourth of the inner lateral side walls.

15. The nested insulated packaging assembly of claim 1, wherein:

a first portion of the first inner surface defined by the top fold faces a second portion of the first inner surface defined by the bottom fold;

the back fold is disposed between the top fold and the bottom fold; and the top fold covers the outer top side wall.

16. The nested insulated packaging assembly of claim 1, wherein the outer box defines an outer storage cavity with a top opening, and the top fold is configured to cover the top opening.

17. The nested insulated packaging assembly of claim 1, wherein:

the plurality of outer lateral side walls defines an outer box opening;

the outer top side wall and the top fold are sized and shaped complimentary to the outer box opening;

the outer top side wall and the top fold are configured to cover the outer box opening in a closed position;

the outer top side wall is hingedly connected to a first outer lateral side wall of the outer lateral side walls by an outer top hinge;

the top fold is folded relative to the back fold about a first bend line;

the first bend line is substantially parallel to the outer top hinge; and the back fold covers the first outer lateral side wall.

18. The nested insulated packaging assembly of claim 17, wherein:

the outer top side wall is configured to rotate about the outer top hinge in a first direction to uncover the box opening; and the top fold is configured to rotate about the first bend line in the first direction to uncover the box opening.

19. The nested insulated packaging assembly of claim 1, wherein the first material is corrugated cardboard.

20. The nested insulated packaging assembly of claim 1, wherein the first material is a rigid, planar material.

21. A method of assembling a nested insulated packaging comprising:

positioning a first thermal liner in an outer box, the first thermal liner comprising a top fold, a back fold, and a bottom fold, the outer box including an outer top side wall, an outer bottom side wall, and a plurality of outer lateral side walls, wherein positioning the first thermal liner comprises:

folding the bottom fold relative to the back fold, covering the outer bottom side wall with the bottom fold, and covering a one of the outer lateral side walls with the back fold;

positioning a second thermal liner in the outer box, the second thermal liner comprising a left fold, a front fold, and a right fold, wherein positioning the second thermal liner comprises:

folding the left fold and the right fold in a same direction relative to the front fold so that the second thermal liner is C-shaped, and covering a second, a third, and a fourth of the outer lateral side walls with the second thermal liner;

positioning an inner box in the outer box, the inner box including an inner top side wall, an inner bottom side wall, and at least one inner lateral side wall, the inner top side wall defining a top outer surface, the top outer surface comprising a first material, the at least one inner lateral side wall defining a lateral outer surface and a lateral inner surface, the lateral inner surface disposed opposite from the lateral outer surface, the lateral inner surface at least partially defining an inner storage cavity within the inner box, the lateral outer surface and the lateral inner surface each comprising the first material, the first thermal liner contacting the lateral outer surface at a one of the inner lateral side walls of the inner box, and the second thermal liner contacting the lateral outer surface at a second of the inner lateral side walls of the inner box; and folding the top fold relative to the back fold so that the first thermal liner is C-shaped, the top fold contacting the top outer surface of the inner top side wall.

22. The method of claim 21, further comprising bending a top flap of the outer box to cover a top opening of the outer box and sealing the outer box with a sealing mechanism, wherein the sealing mechanism includes least one locking tab and at least one locking slot.

23. The method of claim 21, further comprising positioning a divider in the inner storage cavity of the inner box, the divider defining an upper chamber in the inner storage cavity between the divider and the inner top side wall and defining a lower chamber in the inner storage cavity between the divider and the inner bottom side wall.

24. The method of claim 23, further comprising maintaining the upper chamber at an upper chamber temperature and the lower chamber at a lower chamber temperature different from the upper chamber temperature.

* * * * *